US005575560A

United States Patent [19]

Kaneski et al.

[11] Patent Number: 5,575,560

[45] Date of Patent: Nov. 19, 1996

[54] PAINT TOTE WITH COLAPSIBLE LINER AND TOTE AGITATOR

[75] Inventors: Donald E. Kaneski, High Ridge, Mo.; Ross G. Good, South Lyon, Mich.

[73] Assignee: Chrysler Corporation, Auburn Hills, Mich.

[21] Appl. No.: 512,984

[22] Filed: Aug. 9, 1995

[51] Int. Cl.[6] ..... B01F 11/00

[52] U.S. Cl. ..... 366/219; 222/386.5; 366/239

[58] Field of Search ..... 366/219, 237, 366/239, 240, 110, 111; 222/386.5, 105; 220/402, 403, 404

[56] References Cited

U.S. PATENT DOCUMENTS

| | | | |
|---|---|---|---|
| 1,254,429 | 1/1918 | Parmeley . | |
| 1,293,951 | 2/1919 | Shevalier . | |
| 1,342,212 | 6/1920 | Hainsey . | |
| 1,436,778 | 11/1922 | Rowe et al. . | |
| 1,944,042 | 1/1934 | Thompson | 220/65 |
| 2,431,872 | 12/1947 | Kavula | 259/75 |
| 2,578,918 | 12/1951 | Boddy et al. | 91/43 |
| 3,087,413 | 4/1963 | Burroughs | 366/237 |
| 3,128,082 | 4/1964 | Cline | 259/72 |
| 3,235,202 | 2/1966 | Kitselman | 366/237 |
| 3,271,012 | 9/1966 | VanBael | 259/29 |
| 3,321,070 | 5/1967 | Childs | 206/46 |
| 3,363,461 | 1/1968 | Minkoff | 73/194 |
| 3,377,987 | 4/1968 | Juvinall et al. | 118/626 |
| 3,643,854 | 2/1972 | Holmes | 229/14 |
| 3,995,839 | 12/1976 | Zingg | 259/22 |
| 4,834,261 | 5/1989 | Brdlik | 220/404 |
| 4,960,227 | 10/1990 | Coleman | 222/94 |
| 5,050,438 | 9/1991 | Ezell, Jr. | 73/862 |
| 5,094,543 | 3/1992 | Mursa | 366/247 |
| 5,215,253 | 6/1993 | Saidman et al. | 239/61 |
| 5,230,739 | 7/1993 | Bartow | 118/694 |
| 5,265,766 | 11/1993 | Kurtzahn et al. | 222/105 |
| 5,273,357 | 12/1993 | Currie | 366/110 |
| 5,309,403 | 5/1994 | Bartow | 366/130 |
| 5,339,989 | 8/1994 | Coleman | 222/105 |
| 5,397,020 | 3/1995 | Witt | 220/404 |

*Primary Examiner*—Robert W. Jenkins
*Attorney, Agent, or Firm*—Edward A. Craig

[57] ABSTRACT

A tote tank has a flexible, collapsible liner for water-based or water-borne paint. The liner when full of paint fills the tank and lines the interior walls thereof. A paint outlet from the liner extends through a wall of the tank for withdrawing paint. A paint inlet to the liner is provided for filling the line with paint and is normally closed and sealed by a closure plate. An air inlet to the tank allows the liner to collapse as paint is withdrawn. The tank is mounted on a pivot and cranks are linked to the tank to rock it back and forth to keep the paint in an agitated condition.

7 Claims, 2 Drawing Sheets

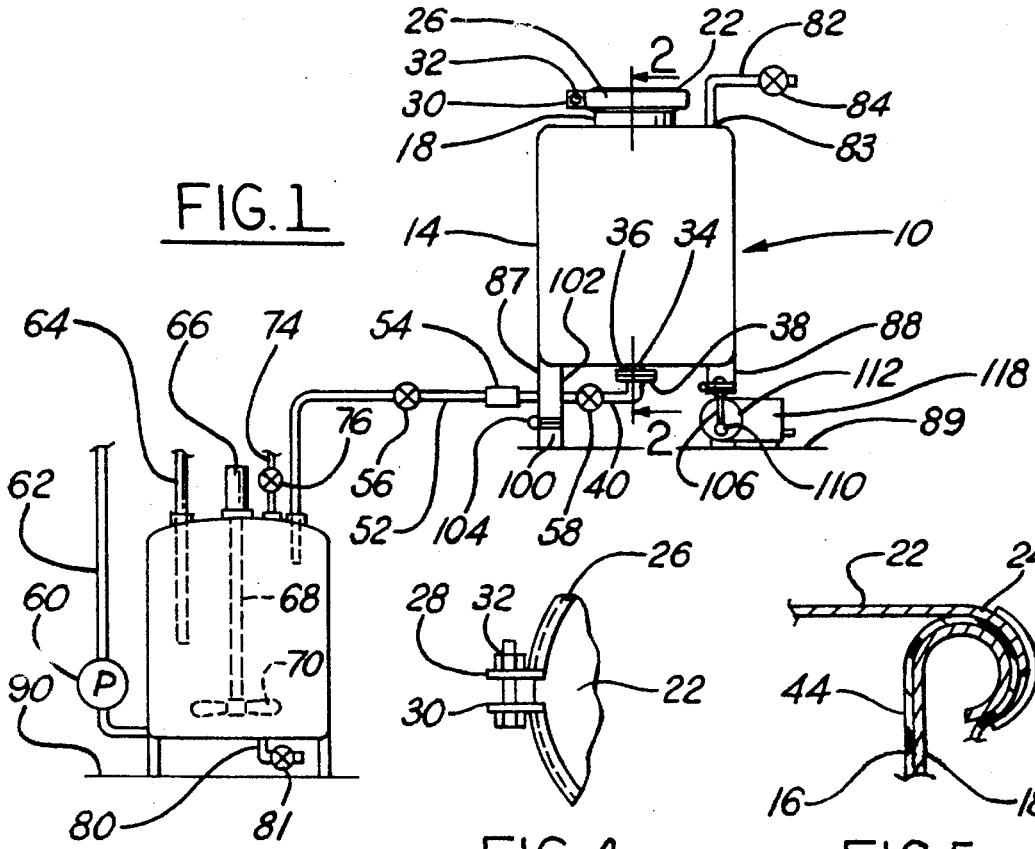
FIG. 1
FIG. 4
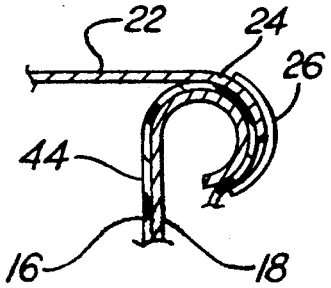
FIG. 5
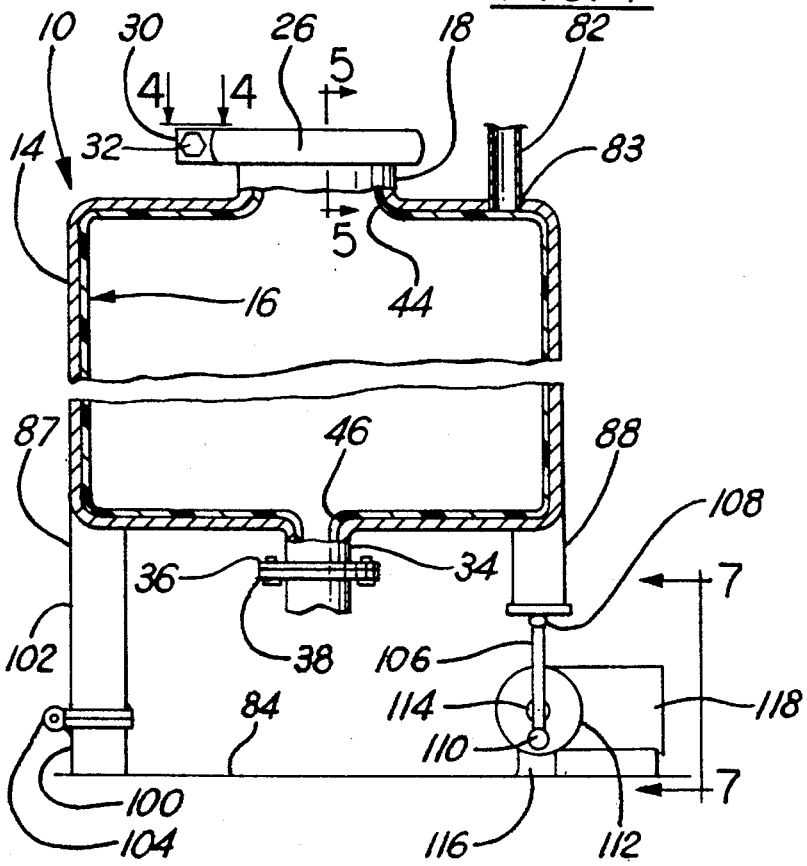
FIG. 2

PAINT TOTE WITH COLAPSIBLE LINER AND TOTE AGITATOR

FIELD OF THE INVENTION

This invention relates generally to paint totes and refers more particularly to a paint tote with a collapsible liner and a tote agitator.

BACKGROUND AND SUMMARY

Water-based or water-borne paints are being used more often in the manufacture of motor vehicles. Water-based paints do not contain harmful solvents which have contributed to air pollution problems in the past. However, certain problems have been encountered with water-based paints.

It has been learned, for example, that when water-based paints are stored in tote tanks made of stainless steel, paint particles form which dry and adhere to the inner surface of the tank as the level of paint drops. These particles become intermixed with the paint and the result is an imperfect coat of paint on the motor vehicle or other article being painted.

This problem has been resolved by providing a collapsible plastic liner within the tote tank. The paint is contained in the liner and the liner collapses as the paint is used up, thereby preventing paint from forming on the surface thereof. An air opening into the tank is preferably provided to allow for the uninhibited collapse of the liner and to fill with air that portion of the tank not occupied by the liner as the liner collapses. As a further safeguard, the paint tote is preferably continuously rocked back and forth to keep the paint in an agitated condition.

Preferably, means are provided for measuring the volume of air entering the tank which is an indication of the amount of paint withdrawn or dispensed. This information may be useful in determining how much paint is being used in a given day and also for environmental purposes. Preferably, the liner is made of a resinous plastic material such, for example, as polyethylene.

One object of this invention is to provide a paint tote having the foregoing features and capabilities.

Another object is to provide a paint tote which is made of a relatively few simple parts, is rugged and durable in use, and is capable of being readily and inexpensively manufactured and assembled.

Other objects, features and advantages of the invention will become more apparent as the following description proceeds, especially when considered with the accompanying drawings.

BRIEF DESCRIPTION OF THE DRAWINGS

FIG. 1 is a semi-diagrammatic view of apparatus for storing and dispensing paint, constructed in accordance with the invention.

FIG. 2 is a sectional view with parts broken away taken on the line 2—2 in FIG. 1 and showing the liner within the tote tank when substantially full of paint and lining the walls of the tote tank.

FIG. 4 is a fragmentary view taken on the line 4—4 in FIG. 2.

FIG. 5 is a fragmentary sectional view taken on the line 5—5 in FIG. 2.

DETAILED DESCRIPTION OF A PREFERRED EMBODIMENT

Figure 3:
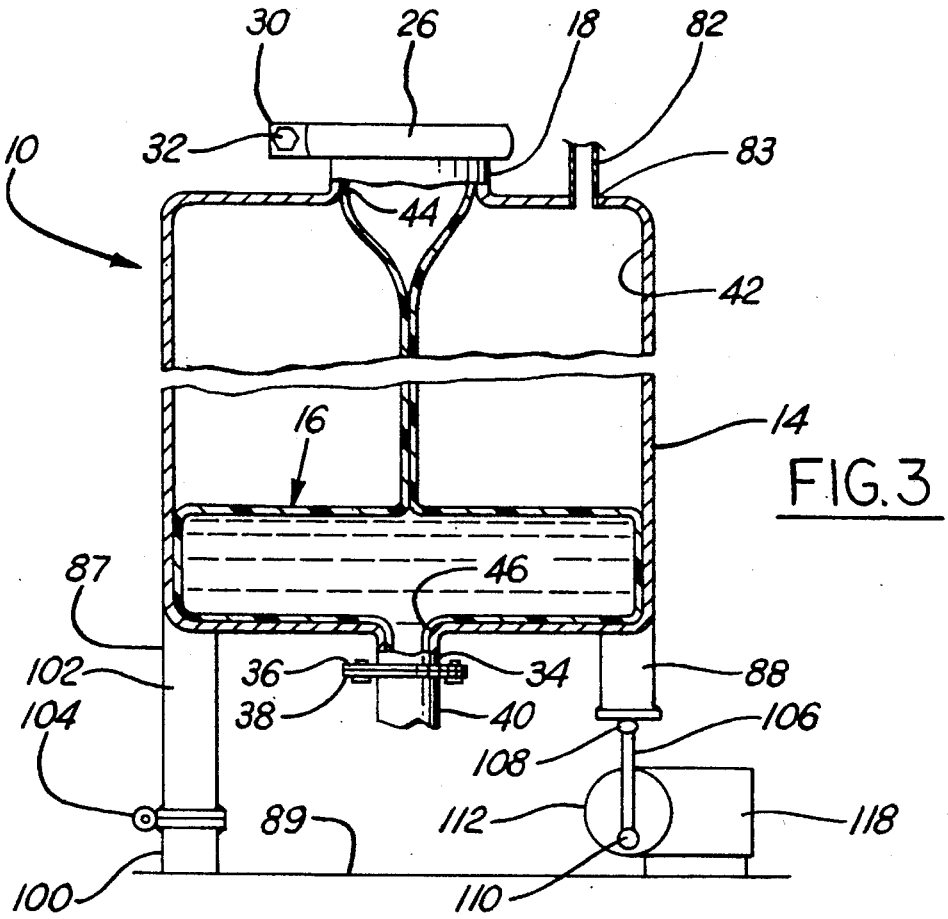
FIG. 3 is a sectional view similar to FIG. 2 but showing the liner after some of the paint has been withdrawn.

Referring now more particularly to the drawings, the apparatus there shown comprises a paint tote 10 and a recirculation tank 12.

The paint tote 10 comprises a tank 14 having a flexible, collapsible inner liner 16, preferably made of a resinous plastic material such, for example, as polyethylene.

The tank 14 is a rigid, hollow container made of any suitable material such, for example, as stainless steel. The tank 14 has an integral tubular extension at the top forming an inlet 18. The top of the inlet has an annular, laterally outwardly turned bead 20. A closure plate 22 for the inlet has a downwardly curved, annular, radially outer edge portion 24 which fits over the bead 20 to seal the inlet. A transversely split clamping ring 26 encircles the radially outer edge portion 24 of the closure plate. The spaced apart ends 28 and 30 of the split ring 26 are bent laterally outwardly and connected by a threaded nut and bolt assembly 32 which when tightened draws the ends 28,30 together to secure the closure plate. The closure plate is, of course, removable after first loosening the nut and bolt assembly 32 and removing the split ring 26.

The tank 14 has an integral tubular extension at the bottom forming an outlet 34. The bottom of the outlet has a laterally outwardly extending flange 36 which is bolted to a flange 38 on the end of a discharge pipe 40. A gasket seal may, if desired, be clamped between the flanges 36 and 38.

The liner 16 is in the form of a substantially closed vessel for paint which is sealed against the entry of air or contaminants and is disposed in the chamber 42 of tank 14. The upper end of the liner has a tubular extension which extends into and is concentric with tank inlet 18, forming a liner inlet 44. Liner inlet 44 has an annular upper end which is rolled over the bead 20 at the top of the tank inlet and clamped between the bead and the edge portion 24 of the closure plate 22. The liner is adapted to contain water-based or water-borne paint which may be introduced through the inlet 44 when the closure plate 22 is removed.

The liner when full of paint substantially fills the chamber 42 within the tank, lining the walls thereof as shown in FIG. 2. When filled, the liner may be slightly stretched beyond its natural free state condition, although not necessarily.

The lower end of the liner has an outlet 46 which extends into the outlet 34 of the tank. The end of outlet 46 is preferably turned laterally outwardly and clamped between the flanges 36 and 38 and sealed thereby. It has been stated that the liner is sealed against the entry of air or contaminants and this is true since the inlet 44 at the top is only for the introduction of paint and this inlet is sealed when capped by the closure plate 22. The liner should be filled with paint up to the top of the inlet to exclude any air. Likewise, the outlet 46 at the bottom is only for the discharge of paint into a pipe 40 leading to the recirculation tank 12. Pipe 40 is closed when paint is not being withdrawn.

The recirculation tank 12 is a hollow, rigid container adapted to contain paint which is supplied by the tote 10. The pipe 40 leading from the tote extends into the recirculation tank 12 to discharge paint thereinto when desired. The pipe 40 comprises two sections 50 and 52 which are connected together preferably by a quick disconnect coupling 54. Shut-off valves 56 and 58 are provided in the respective pipe sections 50 and 52. The recirculation tank 12 contains paint for immediate use which is withdrawn therefrom by a pump 60 and delivered through line 62 to a station where a painting operation is to be carried out. A return line 64 is provided for returning unused paint to the recirculation tank from the painting station.

A motor 66 on the top of the recirculation tank drives a shaft 68 extending into the tank 12 which has a propeller-like paddle or agitator 70 on the lower end. By slow speed rotation of the shaft 68, the agitator constantly stirs the paint in the recirculation tank. A pipe 74 leading into the recirculation tank 12 through the top is provided as an air bleed and also for the purpose of taking and analyzing paint samples. Pipe 74 is equipped with a shut-off valve 76. A drain line 80 at the bottom of the tank is provided, equipped with a shut-off valve 81.

To facilitate the collapse of the liner 16 as paint is withdrawn, an air inlet pipe 82 to the tank 14 is provided which opens into an air inlet 83 in the top wall of the tank. The air inlet pipe 82 is controlled by a shut-off valve 84. As the liner collapses, a slight vacuum develops between the liner 16 and the inner walls of tank 14, drawing air into the pipe 82.

The tote 14 is supported on a supporting surface 89 by rear legs 87 and front legs 88. The recirculation tank 12 is supported at a level beneath the supporting surface for the tote tank on a supporting surface 90 so that paint will flow naturally by gravity from the tote tank 14 to the recirculation tank 12.

Figure 6:
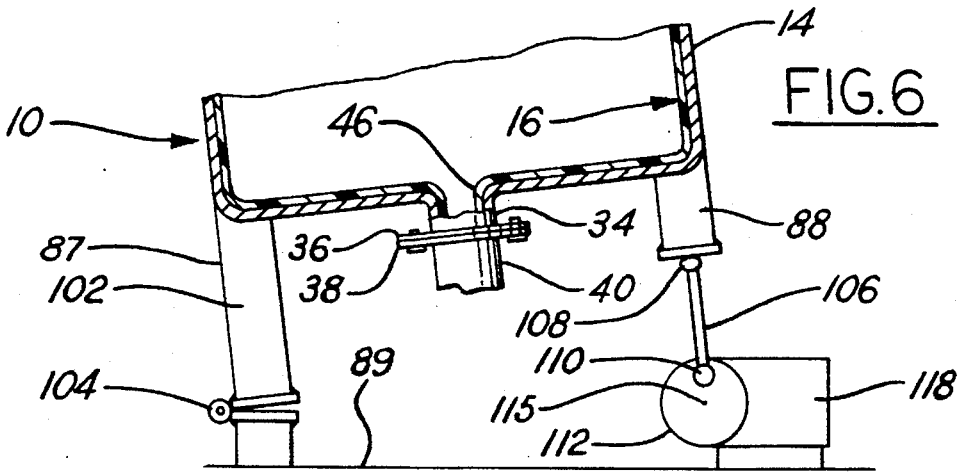
FIG. 6 is a view similar to FIG. 3, but showing the tote tank tilted.
Figure 7:
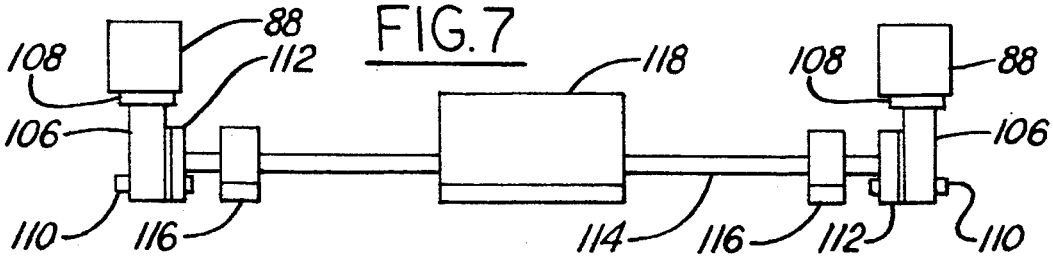
FIG. 7 is a view taken on the line 7—7 in FIG. 2.

The two rear legs 87, only one of which appears in the drawings, are spaced apart and each has a lower portion 100 secured to the support surface 89 and an upper portion 102 secured to tank 14. The upper leg portions 102 are pivoted on aligned axes 104 to the lower leg portions 100 for pivotal movement so that the tank may be rocked back and forth about the pivots 104 between the positions of FIGS. 3 and 6.

The upper ends of links 106 are respectively pivoted on aligned axes 108 to the spaced apart front legs 88. The lower ends of links 106 are pivoted at 110 to the respective circular cranks 112 near the outer periphery thereof. Cranks 112 are concentric with and keyed to the outer ends of a shaft 114 which is journalled for rotation about fixed axis 115 in pillow blocks 116. The axes 104,108,110 and 115 are parallel to one another. The shaft is rotated by an air motor 118. Rotation of the shaft 114 and cranks 112 causes back and forth rocking or oscillation of the tote tank about axis 104 between the positions of FIGS. 3 and 6.

In use, the liner 16 within the tote tank 14 will be filled to capacity with water-based or water-borne paint through the inlet 44 at the top, the closure plate 22 having been first removed for this purpose and then replaced to seal the contents of the liner. In this condition, the liner assumes the position shown in FIG. 2 in which it occupies the entire space within the tank and substantially fully lines the walls thereof. The tote 10 thus serves as a place for storage of paint to be supplied to the recirculation tank 12 when needed to perform a painting operation.

Paint is withdrawn from the tote by opening the shut-off valves 56 and 58 in the pipe 40 leading to the recirculation tank. The liner gradually collapses and assumes the position shown in FIG. 3 in which the top portion of the liner follows the surface of the paint downward as the paint is withdrawn so that the space within the liner is full of nothing but paint. All the time that paint is being withdrawn, the air motor 118 is operated to rock the tote tank 14 back and forth. Even during intervals when paint is not being withdrawn, it is desirable to rock the tote tank. No air or other foreign material is allowed into the liner since the inlet 44 is closed and the pipe 40 extends directly to the recirculation tank. Clearly no paint touches any part of the stainless steel tank 14, all of the paint being inside of the liner.

After a sufficient volume of paint is transferred to the recirculation tank, one or both of the shut-off valves 56,58 is closed. More paint may be delivered to the recirculation tank by simply opening both shut-off valves. After the paint has been substantially fully withdrawn from the liner 16 in the tank 14, the liner may be refilled with paint by merely removing the cover plate 22 to open the inlet 44. Normally the tote would not be refilled with paint until all or substantially all of the paint has been withdrawn from the liner, which would be a condition considerably beyond that which is illustrated in FIG. 3.

It has been found that by holding the water-based paint in a flexible liner, and ensuring that the liner contains no air or anything besides paint, and constantly rocking the tote tank, undesirable paint particles will not form and interfere with the application of a perfect coat of paint.

What is claimed is:

1. A paint tote comprising a rigid, hollow tank having walls defining an inner chamber, a flexible, collapsible liner in the chamber of said tank, said liner being in the form of a substantially closed vessel for water-based paint sealed against the entry of air or contaminants thereinto, said liner when full of paint substantially filling said chamber and lining the walls thereof, a paint outlet extending from said liner through one of the walls of said tank for dispensing paint from said liner, an air inlet opening into said chamber to allow the collapse of said liner as paint is dispensed therefrom and to fill with air that portion of the chamber not occupied by the liner as the liner collapses, and means for agitating said tank.

2. A paint tote as defined in claim 1, wherein said agitating means comprises a pivot support for said tank having a pivot axis, and means for rocking said tank about said pivot axis.

3. A paint tote as defined in claim 2, wherein said rocking means comprises a rotary crank mounted for rotation about a fixed axis, a link pivoted to said tank and pivoted to said crank at a point spaced from said fixed axis of rotation, and means for rotating said crank about said fixed axis of rotation.

4. A paint tote as defined in claim 3, and further including a paint inlet extending through another of the walls of said tank and into said liner for filling said liner with paint, and a removable closure for closing and sealing said inlet.

5. A paint tote as defined in claim 1, wherein said tank has spaced apart rear legs pivotally supporting said tank for rocking movement about a first pivot axis, said tank has spaced apart front legs, spaced apart rotary cranks mounted for rotation about a second axis, links pivotally connected to said respective front legs and pivotally connected to said respective cranks at a point spaced from said second axis, a shaft connected to said cranks, and power means for rotating said shaft to simultaneously rotate said cranks and cause said tank to rock about said first pivot axis.

6. A paint tote as defined in claim 5, and further including a paint inlet extending through another of the walls of said tank and into said liner for filling said liner with paint, and a removable closure for closing and sealing said inlet.

7. A paint tote as defined in claim 6, wherein said liner is made of a resinous plastic material.

* * * * *